US005516099A

United States Patent [19]

Strong

[11] Patent Number: 5,516,099

[45] Date of Patent: May 14, 1996

[54] BALL WITH PROJECTING LOOPS

[76] Inventor: Jot Strong, 16195 Monterey Rd., Suite 106, Morgan Hill, Calif. 95037

[21] Appl. No.: 402,010

[22] Filed: Mar. 10, 1995

[51] Int. Cl.[6] ..... A63B 37/14

[52] U.S. Cl. ..... 273/58 K; 273/58 C

[58] Field of Search ..... 273/58 R, 58 K, 273/58 A, 58 B, 58 BD, 58 C, 58 D, 65 EG, 428, 346, 343

[56] References Cited

U.S. PATENT DOCUMENTS

| | | | |
|---|---|---|---|
| 4,277,076 | 6/1981 | Song et al. | 273/58 A |
| 4,756,529 | 7/1988 | Stillinger | 273/428 |
| 4,927,141 | 5/1990 | Paranto | 273/58 K |
| 4,962,926 | 10/1990 | Chen | 273/428 |
| 4,991,841 | 2/1991 | Paranto | 273/58 K |
| 5,186,457 | 2/1993 | Cole | 273/428 |
| 5,254,379 | 10/1993 | Kotsiopoulos et al. | 273/58 B |

*Primary Examiner*—Steven B. Wong
*Attorney, Agent, or Firm*—Keith Kline

[57] ABSTRACT

A ball including a core element with multiple loops extending from its exterior surface. The core element includes receiving apertures that receive loop elements. The loop elements extend outward from the core of the ball, permitting a user to catch the ball simply by allowing one or more of the loops to pass over his finger(s).

1 Claim, 3 Drawing Sheets

BALL WITH PROJECTING LOOPS

FIELD OF THE INVENTION

The present invention relates generally to toys, and more particularly is a novelty ball.

BACKGROUND OF THE INVENTION

Balls in all their multitude of incarnations have been with us throughout history. Because of their continuing utility as a toy, balls have been the subject of a good deal of inventive activity. Much of this activity has been directed to creating balls that are easier for the user to catch.

One modification established in the prior art is a ball with extending filaments that may be grasped by the user. This variation is disclosed in U.S. Pat. No. 4,756,529, "GENERALLY SPHERICAL OBJECT WITH FLOPPY FILAMENTS TO PROMOTE SURE CAPTURE", by Stillinger. The device comprises multiple filaments extending from a core. The filaments are designed and intended to thread their way through a user's fingers, and are not designed or intended to form loops which surround a user's fingers.

Another device with extending filaments is the "NOVELTY BALL" , U.S. Pat. No. 4,927,141, by Paranto. This device has a far less dense pattern of the tentacles, the tentacles being used chiefly to slow the travel of the ball.

The inventor of this device believes that one shortcoming in the prior art is that there is no device which would enable a very small child, or anyone else, to catch a ball without entrapping it within their hands.

OBJECTS, SUMMARY, AND ADVANTAGES OF THE INVENTION

Accordingly, it is an object of the present invention to provide a ball that is extremely easy for a user to catch.

It is a further object of the present invention to provide a ball that includes extending loops that can be snared on a user's fingers.

In summary, the present invention is a ball comprising a hollow core element with multiple loops extending from its exterior surface. The core element includes densely spaced receiving apertures that receive loop elements. The loop elements extend outward from the core of the ball, providing means for a user to catch the ball simply by allowing one or more of the loops to pass over his finger(s).

An advantage of the present invention is that it allows very small children to "catch" a ball, even if they are not able to entrap the ball within their hands.

A further advantage of the present invention is that it is simple and inexpensive to manufacture.

These and other objects and advantages of the present invention will become apparent to those skilled in the art in view of the description of the best presently known mode of carrying out the invention as described herein and as illustrated in the drawings.

BEST MODE OF CARRYING OUT THE INVENTION

Figure 1:
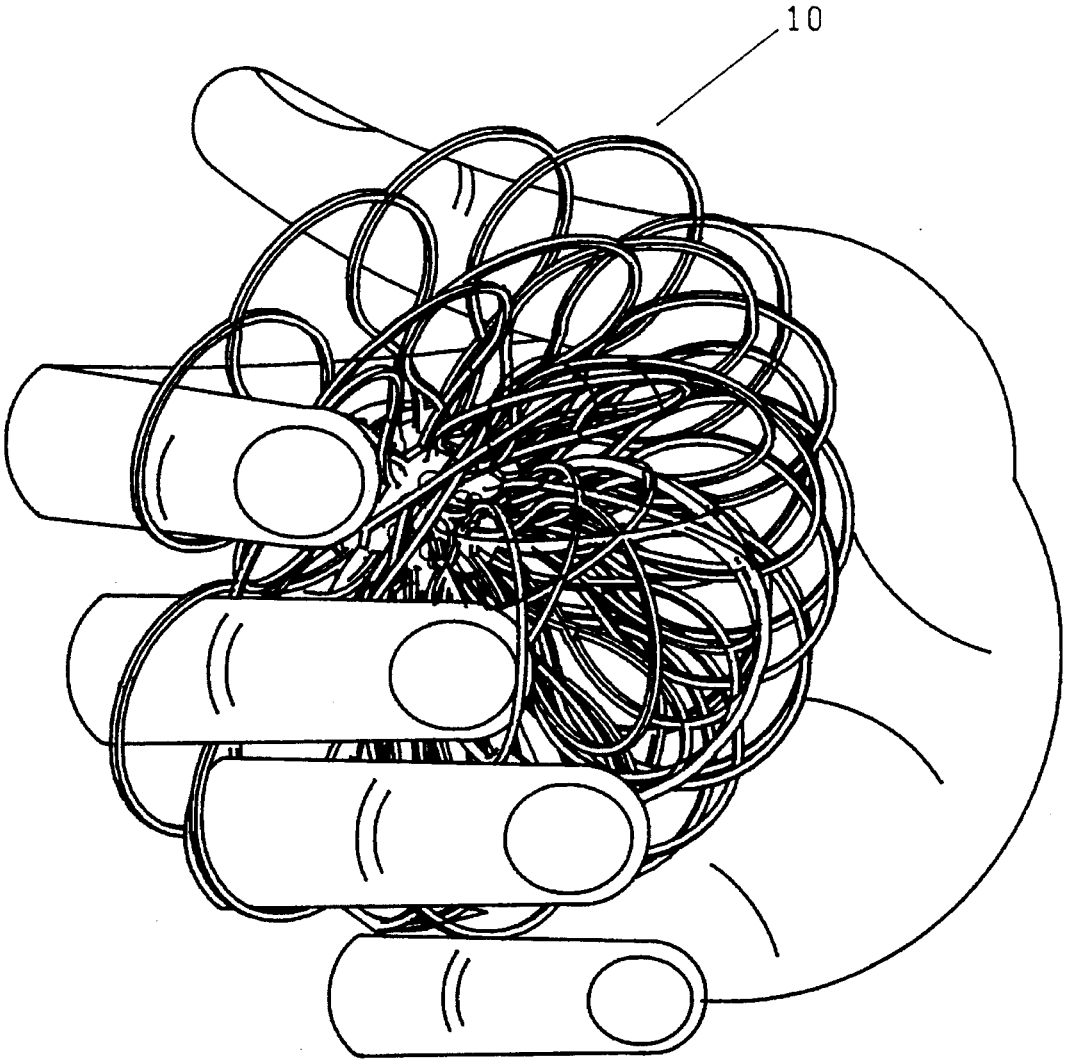
FIG. 1 is a perspective view of the ball of the present invention.

The present invention is a ball 10 with multiple loop elements 12 extending from a core element 14. The loop element 12 includes a loop 16 section and a retaining means. The retaining means comprises a shoulder 20 and a base 22 joined by a neck 24.

Figure 2:
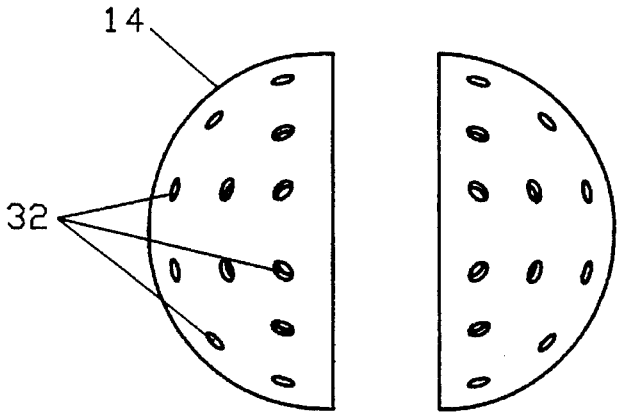
FIG. 2 is a perspective view of the core element.
Figure 4:
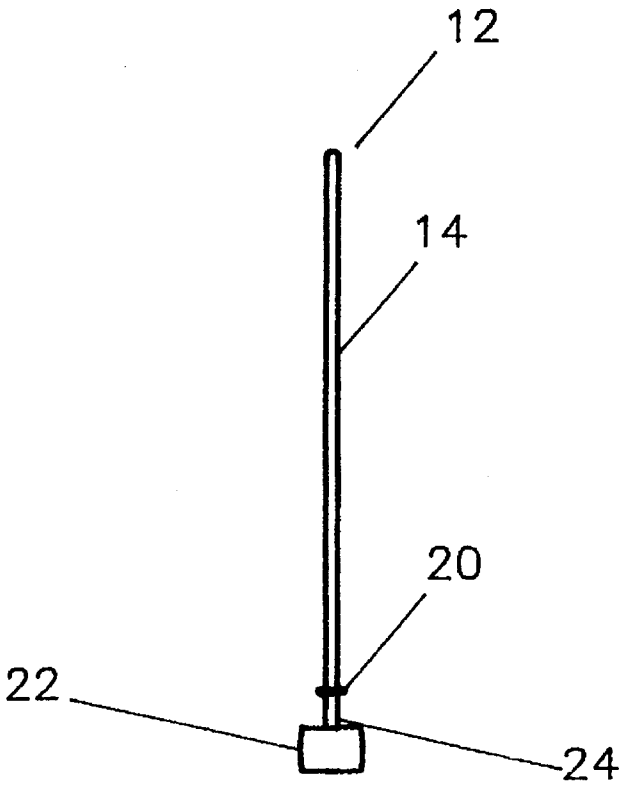
FIG. 4 is a side view of one of the loops utilized in the present invention.
Figure 3:
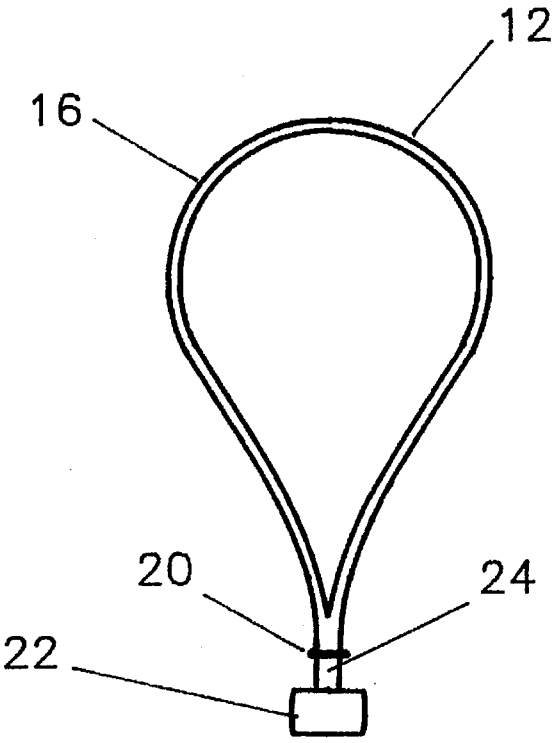
FIG. 3 is a front view of one of the loops utilized in the present invention.

The core element 14 is formed from two hemispheres which are joined together during the manufacturing process. In the preferred embodiment, the two halves are regular in contour at the joining edges, and are simply glued together. (See FIG. 2).

Figure 5:
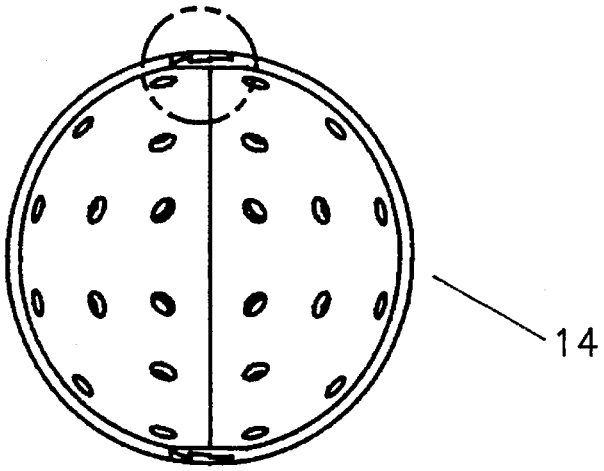
FIG. 5 is a cross section view of the core element of the present invention.
Figure 6:
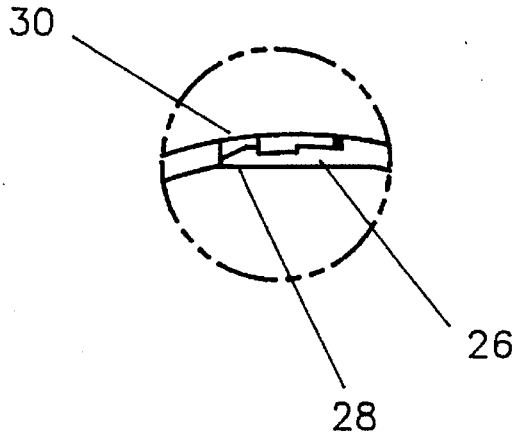
FIG. 6 is a detail view of a joining mechanism for the halves of the core element.

FIGS. 5 and 6 illustrate an alternate method of joining the two halves of the core element 14. In this embodiment, a first half of the core 14 is equipped with two or more fingers 26 that include a projection 28 on a free end of the finger. The projection 28 is received in a recess 30 in the second half of the core element 14. When the two halves of the core 14 are brought together, the finger 26 is deflected until the projection 28 is aligned with the recess 30. When the projection 28 reaches the recess 30, the tension on the finger 26 causes the projection 28 to enter the recess 30. The two halves of the core element 14 are thereby held together by a snap fit.

The ball 10 is assembled as follows: the assembler compresses a loop 16 of the loop element 12 and aligns it with one of a multiplicity of holes 32 in the core element 14. The assembler then pulls the loop 16 through the hole 32 from the inside of the core 14 (the concave surface) to the outside of the core 14 (the convex surface). A tool similar to a crocheting hook is used in the preferred embodiment.

The shoulder 20 is flexible enough so that it can be compressed and forced through the hole 32. After the shoulder 20 passes through the hole 32, its natural resiliency causes it to return to its original orientation, thereby inhibiting the loop 16 from falling into the interior of the ball. The base 22 of the loop element 12, being significantly larger than the hole 32, prohibits the loop element 12 from being pulled entirely out of the core element 14.

This process is repeated until all the holes on a first half of a core 14 have been filled with loop elements 12. Then, the same process is performed on a second half of a core element 14. The two halves of the core are then joined, either by gluing or by some other affixing process, and the finished ball appears as in FIG. 1.

When the ball 10 is thrown, it may be caught by a user without the user closing his fingers around the ball. If one of the catcher's fingers passes through a loop, the ball will be "caught" by that user. This enables even very young children to enjoy a game of catch.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

I claim:

1. A novelty ball comprising:

a core element including multiple loop element receiving means;

a multiplicity of loop elements, each said loop element being affixed in said core element such that a loop extends outward from an outer surface of said core element each said loop element includes a loop portion which closes above a shoulder, the shoulder inhibiting the loop from passing into an interior of said core element, said loop element further including a neck portion which connects the shoulder to a base of said loop element, said base being contained in said interior of said core element and said base being of a conformation to inhibit passage of said base through said receiving means.

* * * * *